US008210375B2

(12) United States Patent
Heiberger

(10) Patent No.: US 8,210,375 B2
(45) Date of Patent: Jul. 3, 2012

(54) POUR CAP FOR FLUID CONTAINERS HAVING GASKET CONFIGURED TO FORM FLUID FLOW PASSAGE AND LOW PRESSURE SEALS IN OPEN POSITION AND HIGH PRESSURE SEAL IN CLOSED POSITION

(75) Inventor: Robert A. Heiberger, Boulder, CO (US)

(73) Assignee: REV 8 Inc., Boulder, CO (US)

( * ) Notice: Subject to any disclaimer, the term of this patent is extended or adjusted under 35 U.S.C. 154(b) by 1125 days.

(21) Appl. No.: 12/062,652

(22) Filed: Apr. 4, 2008

(65) Prior Publication Data

US 2009/0250469 A1 Oct. 8, 2009

(51) Int. Cl.

| | |
|---|---|
| ***B65D 47/04*** | (2006.01) |
| ***B65D 25/40*** | (2006.01) |
| ***B65D 41/04*** | (2006.01) |
| ***B65D 53/00*** | (2006.01) |
| ***B65D 5/00*** | (2006.01) |
| ***B65B 7/28*** | (2006.01) |

(52) U.S. Cl. ..... 215/313; 215/329; 215/44; 215/252; 222/1; 222/566; 220/378

(58) Field of Classification Search ..... 220/378, 220/254.3, 254.4, 254.8, 359.1–359.4, 319, 220/253; 222/1, 566; 215/44, 341, 274, 215/276, 329, 307, 309, 313
See application file for complete search history.

(56) References Cited

U.S. PATENT DOCUMENTS

| | | | | |
|---|---|---|---|---|
| 885,571 | A * | 4/1908 | Bernardin | 222/568 |
| 2,895,656 | A | 7/1959 | Stagmeier | |
| 2,916,174 | A | 12/1959 | Orr | |
| 2,917,198 | A * | 12/1959 | Beall, Jr. | 215/329 |

(Continued)

FOREIGN PATENT DOCUMENTS

GB 1203068 A 8/1970

OTHER PUBLICATIONS

PCT Search Report from International application No. PCT/US2009/044431 dated Jul. 13, 2008, pp. 1-13.

(Continued)

*Primary Examiner* — Robin Hylton
(74) *Attorney, Agent, or Firm* — Stephen A. Gratton

(57) ABSTRACT

A pour cap for a fluid container includes a cap body, a gasket mounted to the cap body, and a threaded ring attached to the cap body. The cap can be positioned on the container in a closed position wherein the container is hydraulically sealed with a high pressure seal, or in an open position wherein fluid flow occurs through flow passages on the gasket and the cap body with first and second low pressure seals preventing unwanted leakage between joining parts on the cap. A method for sealing and pouring a fluid from a container includes the steps of providing the pour cap with the cap body, the gasket and the threaded ring; tightening the cap body to a closed position wherein deformation of the gasket seals the container with a high pressure seal; and then rotating the cap body to an open position wherein the gasket returns to an essentially undeformed state to form a fluid flow passage, while providing first and second low pressure seals for preventing unwanted fluid flow through the cap body and the threaded ring.

23 Claims, 8 Drawing Sheets

U.S. PATENT DOCUMENTS

| | | | | |
|---|---|---|---|---|
| 3,289,887 | A | * | 12/1966 | Farrar et al. ..... 222/1 |
| 3,291,332 | A | | 12/1966 | Morris |
| 3,484,027 | A | | 12/1969 | Micallef |
| 3,812,994 | A | | 5/1974 | Feldman |
| 3,940,001 | A | | 2/1976 | Haefner |
| 4,144,983 | A | | 3/1979 | Pauls et al. |
| 4,781,483 | A | | 11/1988 | Loscheidt |
| 4,858,776 | A | | 8/1989 | Mehra |
| 5,316,193 | A | | 5/1994 | Heiberger |
| 5,494,198 | A | | 2/1996 | Heiberger |
| 5,881,907 | A | * | 3/1999 | Schutz ..... 220/644 |
| 5,988,448 | A | | 11/1999 | Foth |
| 6,116,476 | A | | 9/2000 | Huang |
| 6,569,329 | B1 | | 5/2003 | Nohren, Jr. |
| 6,994,225 | B2 | | 2/2006 | Hakim |
| 7,040,515 | B2 | | 5/2006 | Cote |
| RE39,340 | E | | 10/2006 | Adams et al. |
| 7,189,134 | B2 | | 3/2007 | Nugent et al. |
| 7,299,939 | B2 | | 11/2007 | Ver Hage |

OTHER PUBLICATIONS

International application No. PCT/US2010/056640, Search Report and Written Opinion of the International Searching Authority, Jan. 18, 2010, pp. 1-11.

International application No. PCT/US2009/044431, Search Report and Written Opinion of the International Searching Authority, Jul. 13, 2009, pp. 1-10.

* cited by examiner

POUR CAP FOR FLUID CONTAINERS HAVING GASKET CONFIGURED TO FORM FLUID FLOW PASSAGE AND LOW PRESSURE SEALS IN OPEN POSITION AND HIGH PRESSURE SEAL IN CLOSED POSITION

FIELD

This application relates generally to caps for fluid containers, and more particularly to a pour cap for fluid containers such as sports bottles.

BACKGROUND

Fluid containers, such as sports bottles, provide a fluid source for persons engaged in various activities. Sports bottles typically include a plastic body for containing a fluid, and a cap which threadably attaches to the body. The cap can also include a valve assembly which can be pushed into the cap to seal the fluid, or pulled out of the cap for dispensing the fluid. One aspect of these sports bottles is that the fluid cannot be poured through the valve assembly and out of the bottle into a person's mouth. Rather, the body of the bottle must be squeezed to force the fluid through the valve assembly into the mouth. As the fluid level drops, the bottle must also be manipulated to allow air to flow from the atmosphere through the valve assembly into the bottle.

For pouring the fluid out of a conventional sports bottle the cap can be screwed off, and the fluid poured out of the mouth of the bottle. However, this can be inconvenient in many situations, particularly during strenuous activities such as walking, biking or running. In addition, if the cap is removed from a conventional sports bottle, the fluid is more likely to spill out of the bottle and onto the ground. Also, the mouth of the bottle has a relatively large diameter, such that during drinking with the cap off, the fluid is prone to splatter onto a person's face and clothes.

It would be advantageous for a fluid container to have a cap which permits the fluid to be easily poured from the container without having to remove the cap. It would also be advantageous for a fluid container to have a cap which offers some spill protection, and permits a user to drink without wasting or wearing the fluid. Further, it would be advantageous for a cap to be capable of use with containers having different constructions.

The foregoing examples of the related art and limitations related therewith are intended to be illustrative and not exclusive. Other limitations of the related art will become apparent to those of skill in the art upon a reading of the specification and a study of the drawings. Similarly, the following embodiments and aspects thereof are described and illustrated in conjunction with a pour cap and fluid container which are meant to be exemplary and illustrative, not limiting in scope.

SUMMARY

A pour cap for a fluid container includes a cap body, a gasket mounted to the cap body, and a threaded ring with female threads attached to the cap body. The cap is configured for removable attachment to male threads on the neck of the container. The cap can be positioned on the container in a closed position wherein a sealing surface on the gasket is compressed to form a high pressure seal, or in an open position wherein the fluid can be poured from the container. In the open position, the gasket allows fluid flow through pour openings in the cap body, while first and second low pressure seals formed by first and second portions of the gasket prevent unwanted fluid flow through the cap body and the threaded ring. A first low pressure seal is formed by the gasket on the cap body, and a second low pressure seal is formed by the gasket on the inside diameter of the neck of the container. Stated differently, the cap includes a deformable gasket attached to the cap body having a fluid flow opening, a first portion configured to form a first seal on the cap body, and a second portion configured to form a second seal on an inside diameter or a top surface of the neck of the container.

For switching between the closed position and the open position, a user can rotate the cap counterclockwise about a quarter turn or more. For switching between the open position and the closed position, the user can rotate the cap clockwise to tighten the cap on the threaded neck. In the closed position of the pour cap, the cap body compresses the gasket with a controlled deformation to form the high pressure seal. In the open position of the pour cap, the cap body allows the gasket to restore to an essentially undeformed shape, wherein a fluid flow passage is formed, while the two low pressure seals prevent unwanted fluid flow through the cap body and the threaded ring.

A method for sealing and pouring a fluid from a container having a threaded neck includes the step of providing a pour cap having a cap body with one or more pour openings, a gasket on the cap body, and a threaded ring on the cap body having threads for engaging the threaded neck on the container. The method can also include the step of tightening the cap body on the threaded neck of the container to a closed position wherein controlled deformation of the gasket seals the container with a high pressure seal. The method can also include the step of rotating the cap body on the threaded neck of the container to an open position wherein the gasket returns to an essentially undeformed state to form a fluid flow passage, while providing first and second low pressure seals for preventing unwanted fluid flow through the cap body and the threaded ring. In the open position, the method can also include the step of pouring the fluid through the gasket, through the flow passage, and through the pour openings in the cap body.

BRIEF DESCRIPTION OF THE DRAWINGS

Exemplary embodiments are illustrated in the referenced figures of the drawings. It is intended that the embodiments and the figures disclosed herein are to be considered illustrative rather than limiting.

DETAILED DESCRIPTION OF THE PREFERRED EMBODIMENTS

Figure 1:
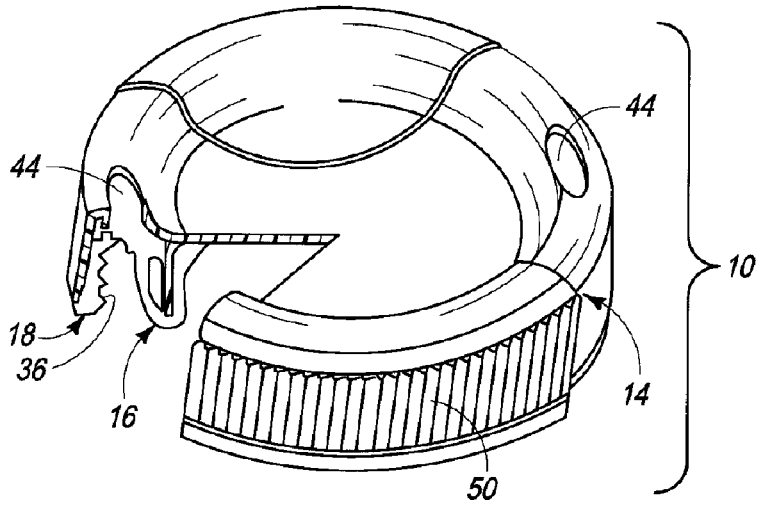
FIG. 1 is a perspective view partially cut away of a first embodiment pour cap.
Figure 2:
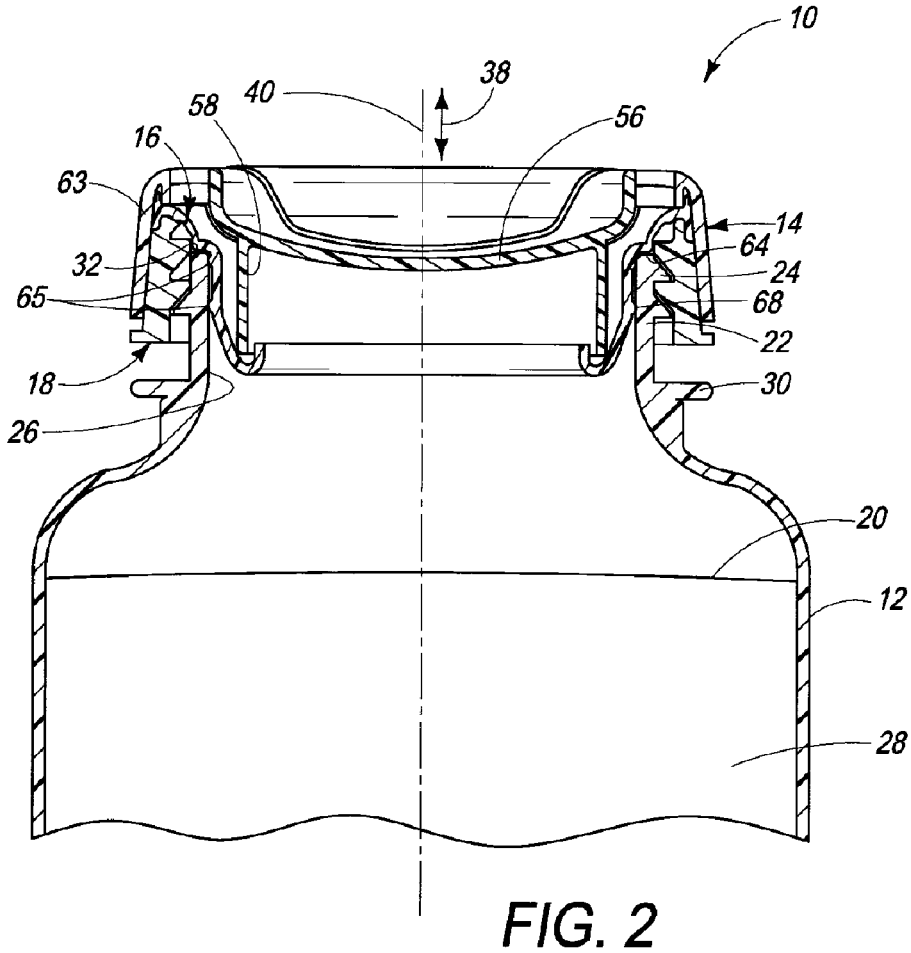
FIG. 2 is a cross sectional view of the pour cap of FIG. 1 attached to a container in an open position.

Referring to FIGS. 1 and 2, a pour cap 10 for a fluid container 12 includes a cap body 14, a gasket 16 mounted to the cap body 14, and a threaded ring 18 attached to the cap body 14. In the pour cap 10 the threaded ring 18 and the cap body 14 comprise separate elements that are bonded together as one. However, it is to be understood that the cap body 14 and the threaded ring 18 can comprise a single piece having a unitary molded construction. Some of the alternate embodiments to be described illustrate a single piece construction.

As shown in FIG. 2, the fluid container 12 is generally cylindrical in shape having an outside diameter sized for handling by a user, and a body having an interior portion 28 adapted to contain a fluid 20. In the illustrative embodiment, the fluid container 12 comprises an injection blow molded plastic bottle adapted to contain a selected volume of the fluid 20 (e.g., 8-64 oz or 200-2000 ml). However, the fluid container can comprise any suitable container such as a sports bottle, a water bottle, a beverage bottle, a medical bottle, a coffee cup or a gasoline can. In addition, rather than being made of plastic, the fluid container 12 can comprise another material such as glass or metal, and can be fabricated using any process known in the art. The fluid container 12 can also include a shoulder 30 which facilitates handling by the user.

As also shown in FIG. 2, the fluid container 12 includes a neck 22 having male threads 24 on an outside diameter thereof, and an inside diameter 26 formed continuously with the interior portion 28 of the container 12. The neck 22 has a continuous circular top surface 32 with a selected diameter, which in the illustrative embodiment is less than that of a remainder of the container 12.

As shown in FIGS. 1 and 2, the threaded ring 18 includes female threads 36 configured for mating engagement with the male threads 24 on the neck 22 of the container 12 for attaching the pour cap 10 to the container 12. In addition, the female threads 36 function to move the pour cap 10 up or down in an axial or z-direction direction, along the longitudinal axis 40 of the container 12, as indicated by double headed cap movement arrow 38 (FIG. 2). With right hand female threads 36, rotation of the threaded ring 18 in a clockwise direction moves the pour cap 10 downward or towards the interior portion 28 of the container 12. Conversely, rotation of the threaded ring 18 in a counterclockwise direction moves the pour cap 10 upward, or away from the interior portion 28 of the container 12. As will be further explained, clockwise rotation allows the pour cap 10 to be positioned in a closed position wherein the container 12 is sealed and no fluid flow through the pour cap 10 is possible. Conversely, counterclockwise rotation of the threaded ring 18 by a quarter turn or more, allows the pour cap 10 to be positioned in an open position wherein fluid flow through the pour cap 10 is permitted. FIG. 2 illustrates the pour cap 10 in an open position. In addition, rotation of the threaded ring 18 in a counterclockwise direction by about 1.5 to 2 turns allows the pour cap 10 to be completely removed from the container 12.

Figure 3:
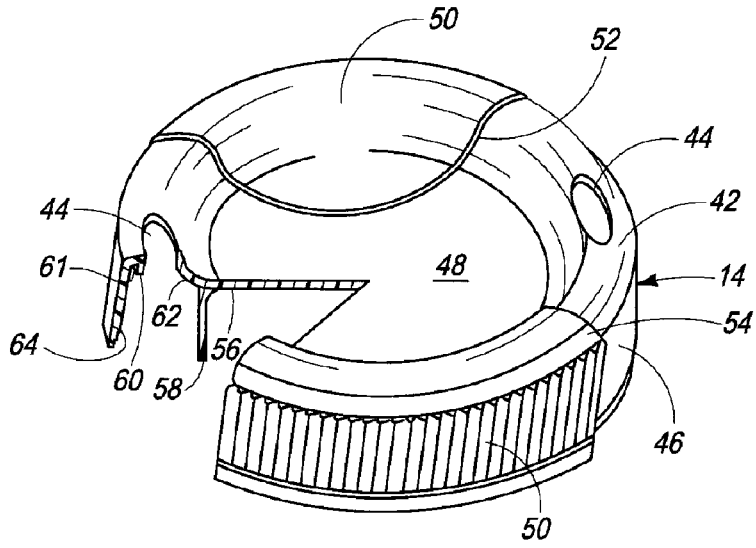
FIG. 3 is a perspective view partially cut away of a cap body for the pour cap of FIG. 1.

Referring to FIG. 3, the cap body 14 is shown separately. The cap body 14 has a generally cylindrical peripheral shape, which is slightly larger than the outside diameter of the neck 22 of the container 12. The outside diameter of the cap body 14 can be selected as required, with from 2 cm to 10 cm being representative. The cap body 14 can be formed of a rigid material such as a hard plastic, using a suitable process such as injection molding, extrusion molding or machining. Suitable plastic materials for the cap body 14 include high density polyethylene (HDPE), low density polyethylene (LDPE), polypropylene (PP), polycarbonate and polyester. Rather than plastic, the cap body 14 can be made out of glass, ceramic or a metal, such as aluminum. As another alternate the cap body 14 can comprise a composite material such as a carbon fiber material.

As shown in FIG. 3, the cap body 14 includes a top surface 42 and an outer circumferential side 46. The cap body 14 also includes a recessed bowl 48 extending from the top surface 42 having a generally concave shape similar to a shallow soup bowl. The cap body 14 also includes two pour openings 44 on the top surface 42 located 180 degrees apart proximate to the outer circumferential side 46 of the cap body 14. The pour openings 44 are generally elliptical in shape and are sized to pour the fluid 20 (FIG. 2) smoothly into another receptacle such as a user's mouth. The circumferential side 46 of the cap body 14 is smooth near the pour openings 44, which permits the user to place his or her mouth around the pour openings 44 without irritation. In addition, the circumferential side 46 of the cap body 14 can include one or more chamfered surfaces 54, such that there are no sharp edges on the cap body 14.

As also shown in FIG. 3, the circumferential side 46 of the cap body 14 includes two grip segments 50 spaced 180 degrees apart, which permit the user to grip the cap body 14 for rotation in either direction. The grip segments 50 include a plurality of parallel spaced grooves, which allow the cap body 14 to be manipulated without slipping from the user's grasp. The grip segments 50 also extend over the top surface 42 and onto the recessed bowl 48 with a curved boundary edge 52.

As also shown in FIG. 3, the cap body 14 includes a continuous sidewall 56 having a desired thickness which closes the recessed bowl 48, and defines the cross sectional shape of the cap body 14. A representative thickness of the sidewall 56 can be from 1 mm to 2.5 mm. The cap body 14 also includes an annular support rib 58 configured to maintain the shape of the gasket 16 (FIG. 2) during use and storage. As shown in FIG. 2, the support rib 58 has an outside diameter which is slightly less than the inside diameter 26 of the neck 22 of the container 12, such that the support rib 58 nests into the inside diameter 26 of the neck 22 but with clearance for the gasket 16. The support rib 58 thus functions to center and seat the gasket 16 in the neck 22 of the container 12.

Figure 6:
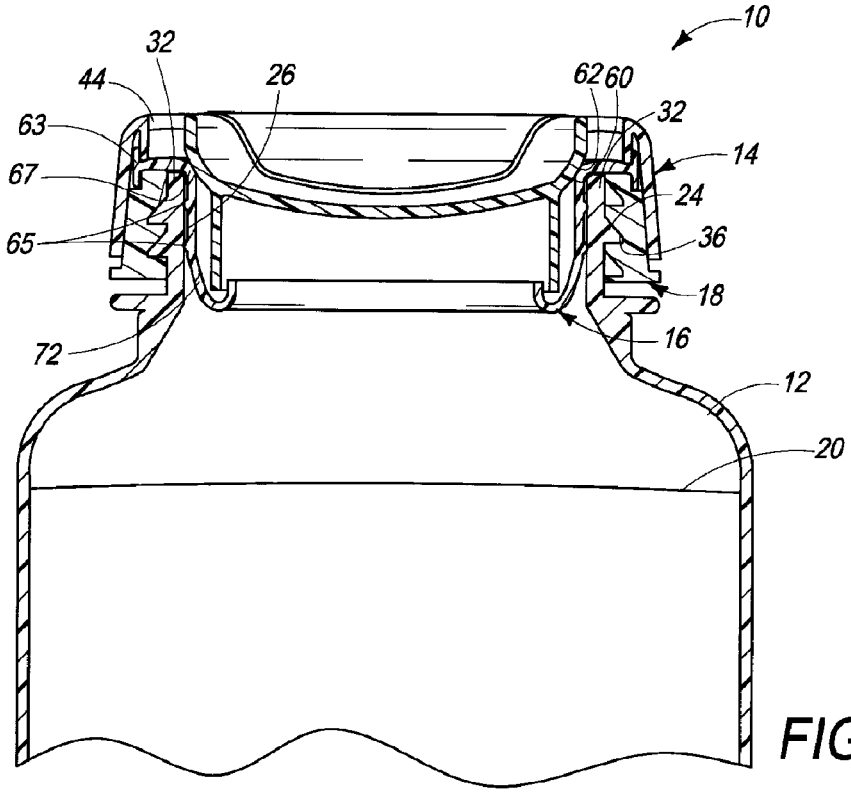
FIG. 6 is a cross sectional view of the pour cap of FIG. 1 attached to the container and shown in a closed position.

As also shown in FIG. 3, the cap body 14 also includes a sealing rib 60 and a groove 61 which are configured to seat the gasket 16 (FIG. 2) for providing a first low pressure seal 63 (FIG. 7) for sealing the container 12 in a manner to be further described. In an alternate embodiment cap body 14A (FIG. 11) to be further described, the sealing rib 60 can be eliminated. The cap body 14 also includes a radiused compression surface 62 configured to compress the gasket 16 (FIG. 2) with a controlled deformation against the top surface 32 (FIG. 6) of the neck 22 of the container 12 to form a high pressure seal 67 (FIG. 6). The cap body 14 also includes an inner edge 64 which is sized and shaped for attachment to the threaded ring 18 (FIG. 2). For example, the threaded ring 18 can be attached to the cap body 14 using bonded connection such as spin welding, a welding adhesive or other suitable adhesive. As another alternative, the threaded ring 18 can be sized and shaped to be snapped into the inner edge 64 of the cap body 14, with the mating surfaces and dimensions providing a press fit. With a press fit, mating members such as splines (not shown) can also be provided for transmitting torque between the threaded ring 18 and the cap body 14.

Figure 4:
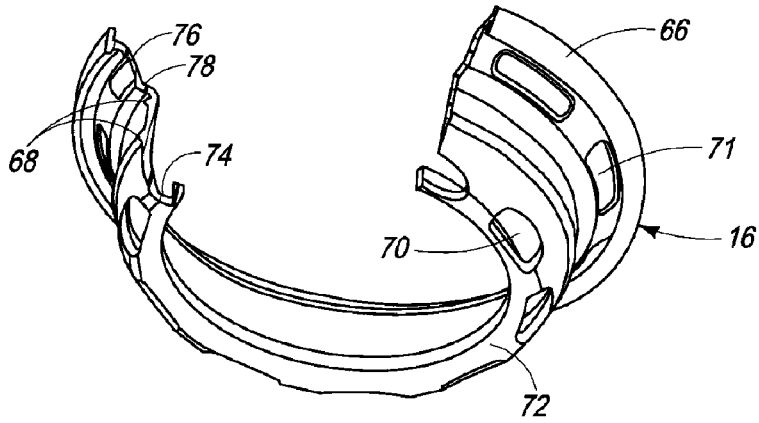
FIG. 4 is a perspective view partially cut away of a gasket for the pour cap of FIG. 1.

Referring to FIG. 4, the gasket 16 is shown separately. The gasket 16 is a generally ring shaped member which is sized and shaped for attachment to the cap body 14. The gasket 16 is configured to seal the container 12 in the closed position of the pour cap 10 with the high pressure seal 67 (FIG. 6). As used herein, the term high pressure seal refers to a hydraulic seal able to resist fluid pressures in the range of 10 to 30 psi. In some of the claims to follow the high pressure seal 67 is referred to as "a third seal". The gasket 16 is also configured to allow fluid flow through the pour openings 44 (FIG. 3) in the open position of the pour cap 10. The gasket 16 is also configured to provide the first low pressure seal 63 (FIG. 7) and the second low pressure seal 65 (FIG. 7) which prevent unwanted fluid flow between the container 12 and the pour cap 10 in the open position of the pour cap 10. As used herein, the term low pressure seal refers to a hydraulic seal able to resist fluid pressures in the range of 0 to 0.5 psi. In some of the claims to follow, the first low pressure seal 63 is referred to as "a first seal" and the second low pressure seal 65 is referred to as "a second seal". The gasket 16 can be made of a resilient polymer material such as silicone, urethane, synthetic rubber, natural rubber, or polyimide. A representative durometer of the gasket 16 can be from 60-85 Shore A.

As shown in FIG. 4, the gasket 16 includes a shoulder 66 configured to removeably secure the gasket 16 to the groove 61 (FIG. 3) in the cap body 14. The gasket 16 also includes a bottom portion 72 having an outside diameter that substantially matches the inside diameter 26 (FIG. 2) of the neck 22 (FIG. 2) of the container 12 (FIG. 2). With the outside diameter of the bottom portion 72 of the gasket 16 being less than the outside diameter of the shoulder 66, that the gasket 16 has a stepped configuration. The bottom portion 72 of the gasket 16 can have a tapered shape, and a chamfered edge, to aid in the insertion of the gasket 16 into the inside diameter 26 (FIG. 2) of the neck 22. The gasket 16 also includes o-ring features 68 configured to compress against the inside diameter 26 (FIG. 2) of the neck 22 of the container 12 to form the second low pressure seal 65. The o-ring features 68 are shown with a rounded or convex geometry for simplicity. However, the o-ring features 68 can be formed with any suitable geometry such as an angular geometry or other shape, as long as a circumferential line of contact is achieved against the inside diameter 26 (FIG. 2) of the neck 22.

As shown in FIG. 4, the gasket 16 also includes a set of fluid flow openings 70 proximate to the bottom portion 72. The fluid flow openings 70 are generally elliptical in shape and can have a desired diameter, number and spacing. For example, the fluid flow openings 70 can be equally radially spaced along the circumference of the bottom portion 72. In the open position of the pour cap 10, the fluid flow openings 70 allow the fluid 20 (FIG. 2) to flow through the gasket 16, and then through the pour openings 44 (FIG. 3) in the cap body 14.

As shown in FIG. 4, the gasket 16 also includes a U-shaped shoulder 74 on the inside surface of the bottom portion 72 proximate to the fluid flow openings 70. The shoulder 74 is configured to center the gasket 16 on the support rib 58 (FIG. 3) of the cap body 14 when the pour cap 10 is mounted to the neck 22 of the container 12. The gasket 16 also includes thinned segments 71 with thinned sidewalls 76 that help the gasket 16 to maintain flexibility and provide a localized place of predictable deformation in the closed position of the pour cap 10 and for maintaining the low pressure seals 63, 65 in the opening position. In addition, as will be further explained, the thinned segments 71 roll back to an essentially undeformed state with little force when the pour cap 10 is loosened.

As shown in FIG. 4, the gasket 16 also includes a sealing surface 78 configured to seal against the top surface 32 (FIG. 2) and inside edge of the neck 22 (FIG. 2) of the container 12. As will be further explained, the sealing surface 62 (FIG. 3) on the cap body 14 compresses the sealing surface 78 of the gasket 16 against the top surface 32 (FIG. 2) and inside edge of the neck 22 (FIG. 2) to form the high pressure seal 67 (FIG. 6). During initial placement of the pour cap 10 on the container 12 it is also necessary to align the gasket 16 such that it seats on the inside diameter 26 of the neck 22 of the container 12. In this position, the o-ring features 68 form the second low pressure seal 65 (FIG. 6). The tapered shape of the end portion 72 of the gasket 16 facilitates this alignment.

Figure 5:
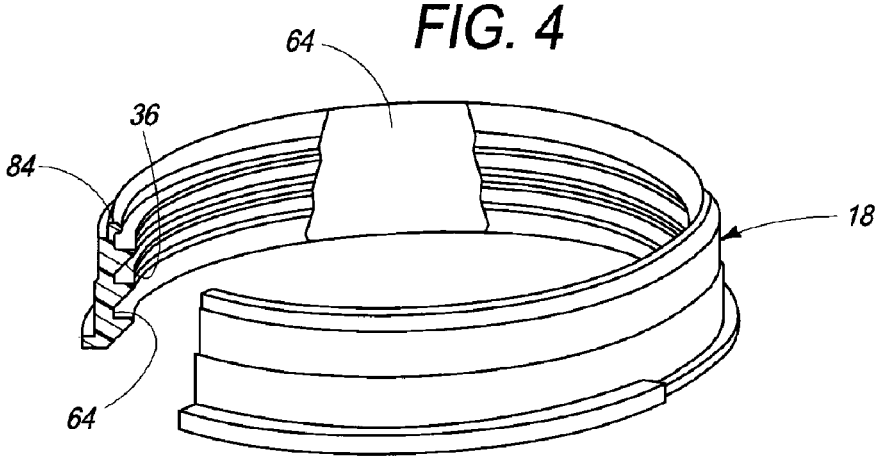
FIG. 5 is a perspective view partially cut away of a thread ring for the pour cap of FIG. 1.

Referring to FIG. 5, the threaded ring 18 is shown separately. The threaded ring 18 is generally ring shaped, and is sized and shaped to be bonded or spin welded to the cap body 14 (FIG. 3). The threaded ring 18 includes the female threads 36 configured for mating engagement with the male threads 24 (FIG. 2) on the neck 22 (FIG. 2) of the container 12. The female threads 36 are not continuous, but rather flat surfaces 64 are formed between the female threads 36 for economic reasons. The threaded ring 18 also includes a pinch rib 84 configured to seal and secure the shoulder 66 of the gasket 16 (FIG. 2) on the pour cap 10. It should be understood, although not shown in the drawings, that the threaded ring 18 can be joined to the cap body 14 with a snap fit geometry in combination with axial splines. The splines would counteract torsional forces that occur during tightening and loosening of the pour cap 10.

Referring to FIG. 6, the pour cap 10 is shown in the closed position. In the closed position, the gasket 16 hydraulically seals the neck 22 of the container 12. For initiating the closed position, the pour cap 10 can be rotated clockwise such that female threads 36 on the threaded ring 18 are tight on the male threads 24 on the neck 22 of the container 12. In addition, the gasket 16 is shaped for compression with a controlled deformation by the surface 78 and the radiused surface 62 of the cap body 14 against the top surface 32 and inside edge of the neck 22 of the container 12. Also in the closed position, the first low pressure seal 63 (FIG. 6) and the second low pressure seal 65 (FIG. 6) are formed by the gasket 16. However, in the closed position the low pressure seals 63, 65 (FIG. 6) are superseded by the high pressure seal 67 (FIG. 6).

Figure 7:
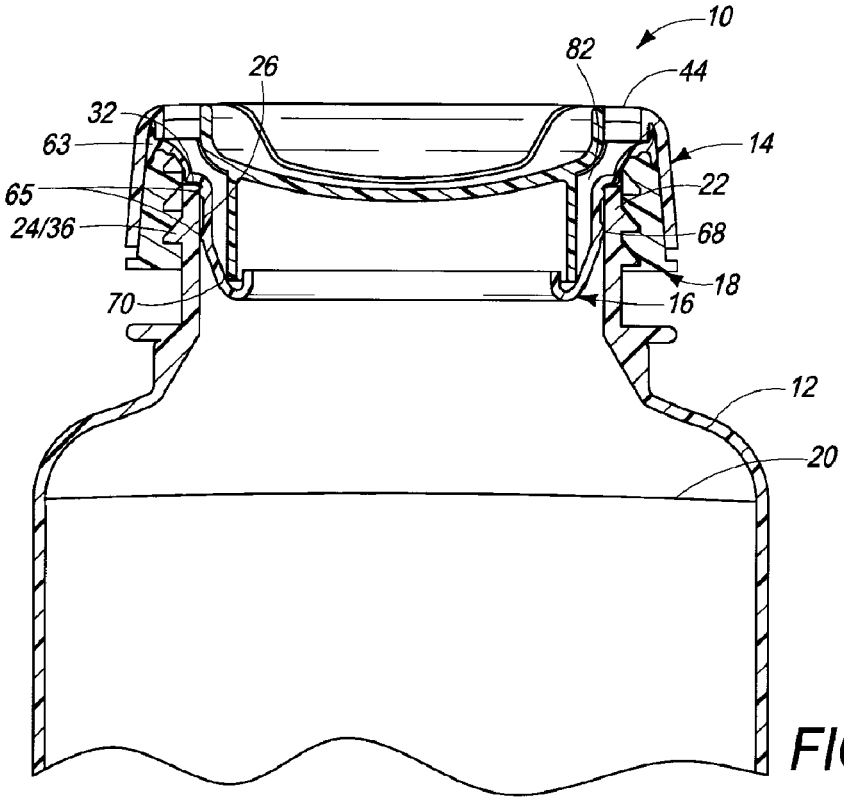
FIG. 7 is a cross sectional view of the pour cap of FIG. 1 attached to the container and shown in an open position.
Figure 8:
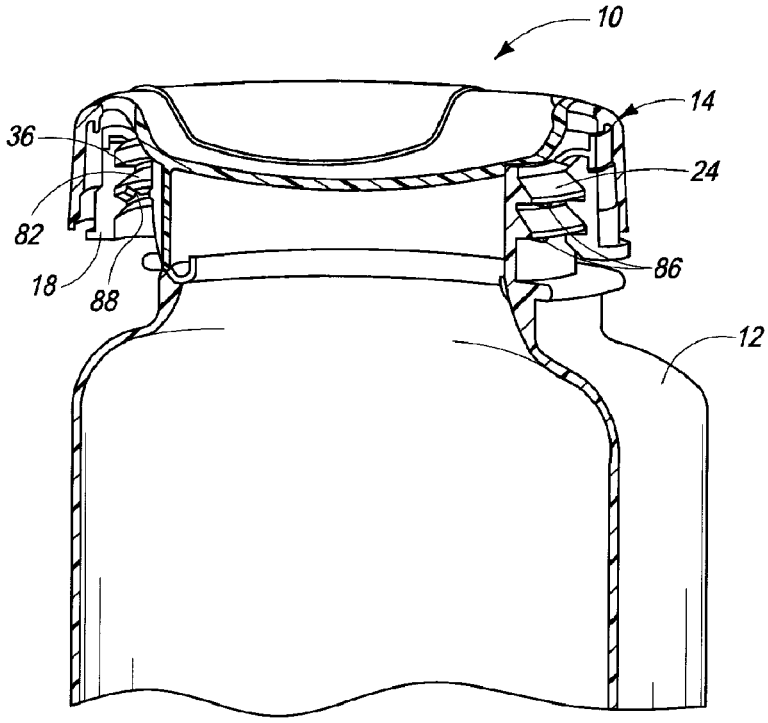
FIG. 8 is a cross sectional view of a pour cap substantially similar to the pour cap of FIG. 1 having mating detents for indicating an open position.
Figure 8A:
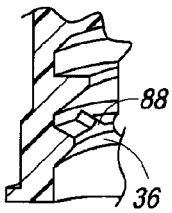
FIGS. 8A and 8B are enlarged portions of FIG. 8 illustrating the mating detents.
Figure 8B:
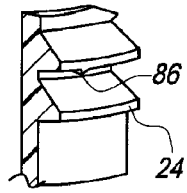

Referring to FIG. 7, the pour cap 10 is shown in an open position. To move the pour cap 10 from the closed position (FIG. 6) to the open position (FIG. 7), the pour cap 10 can be rotated counterclockwise by a quarter turn or more. As will be further explained the cap body 14 can also have an alignment mark 118A (FIG. 13) which indicates the placement of the pour cap 10 in the open or closed position. As another alternative shown in FIG. 8, the male threads 24 on the neck 22 of the container 12 can include detents 86 which mate with mating detents 88 on the female threads 36 of the threaded ring 18 to communicate with noise and resistance the rotation of the pour cap 10 at the open position. However, the detents 86, 88 are optional and are not essential to the operation of the pour cap 10.

As shown in FIG. 7, in the open position, the pour cap 10 has been moved upward by rotation of the female threads 36 on the thread ring 18 against the male threads 24 on the neck 22 of the container 12. In addition, the gasket 16 is no longer compressed such that the high pressure seal on the top surface 32 of the neck 22 of the container 12 is no longer present. However, the first low pressure seal 63 and the second low pressure seal 65 are maintained by the gasket 16. The low pressure seals 63, 65 prevent the fluid 20 from flowing between the gasket 16 and the inside diameter 26 and then through the mating threads 24/36. However, the fluid 20 can flow through the fluid flow openings 70 in the gasket 16 and through a passage 82 formed between the gasket 16 and the support rib 58 of the cap body 14.

FIG. 7 also illustrates the formation of the passage 82 with the gasket 16 in an essentially undeformed state. As shown in FIG. 7, during formation of the passage 82, the controlled deformation of the gasket 16 reverses itself, and the gasket 16 returns essentially to its' molded shape in its' undeformed state. The flow rate of the fluid is affected by the size of the passage 82 and by the size of the pour openings 44 in the cap body 14. One way of insuring a sufficiently large size for the passage 82 is to control the deformation of the gasket 16 as the pour cap 10 is rotated to the open position. In particular, the gasket 16 can be configured such that the deformation essentially occurs in the thinned segments 71 (FIG. 4). As the pour cap 10 is continually loosened by counterclockwise rotation, the gasket shoulder 66 moves away from the top surface 32 of the neck 22 of the container 12, while the thinned segments 71 (FIG. 4) are sufficiently uncurled from the deformed shape of the gasket 16 in the closed position to a state of essentially undeformed geometry. At this point, the passage 82 has a maximum size and provides a maximum flow rate. The o-ring features 68 (FIG. 4) will remain pressed against the inside diameter 26 of the neck 22 during transition between the closed and opened positions and vice versa such that the low pressure seal is always maintained.

Figure 9A:
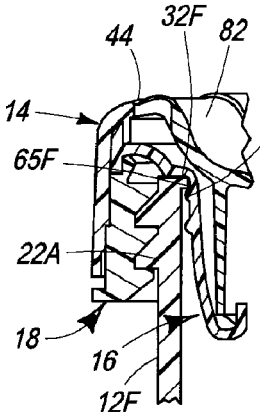
FIG. 9A is an enlarged portion of FIG. 9 showing a seal.
Figure 9:
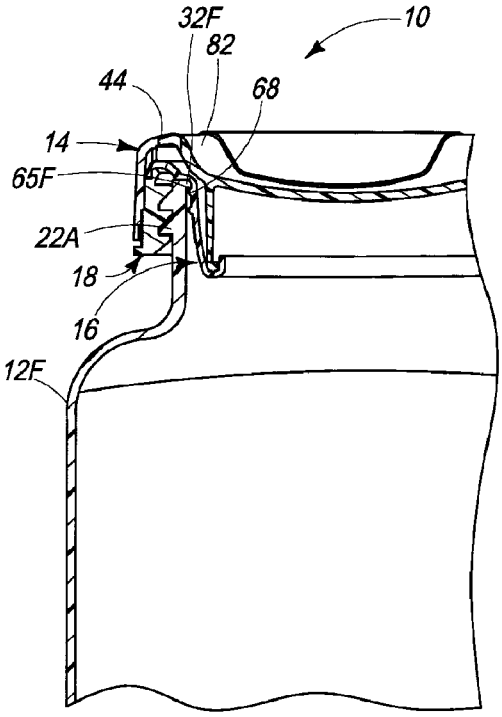
FIG. 9 is a cross sectional view of the pour cap of FIG. 1 attached to a container having an extrusion blow mold construction.

FIG. 9 illustrates a fluid container 12A having a neck 22F with a flanged top surface 32F. In this case the fluid container 12F can be formed using an extrusion blow molding process. As illustrated in FIG. 9, the pour cap 10 can be used with the container 12F substantially as previously explained for the container 12 formed by an injection blow molding process. With the neck 22F only the upper o-ring feature 68 engages the flanged top surface 32F to form a lower pressure seal 65F as shown in FIG. 9A.

Referring to FIGS. 10-15, an alternate embodiment pour cap 10A is shown attached to the container 12. The pour cap 10A includes a cap body 14A, a gasket 16A removeably attached to the cap body 14A, and a threaded ring 18A attached to the cap body 14A. The pour cap 10A is substantially similar in structure and function to the pour cap 10 (FIG. 1) but includes some different features and operational characteristics. One major difference is in the structure and function of the gasket 16A which can be more easily removed from the pour cap 10A for cleaning.

Figure 10:
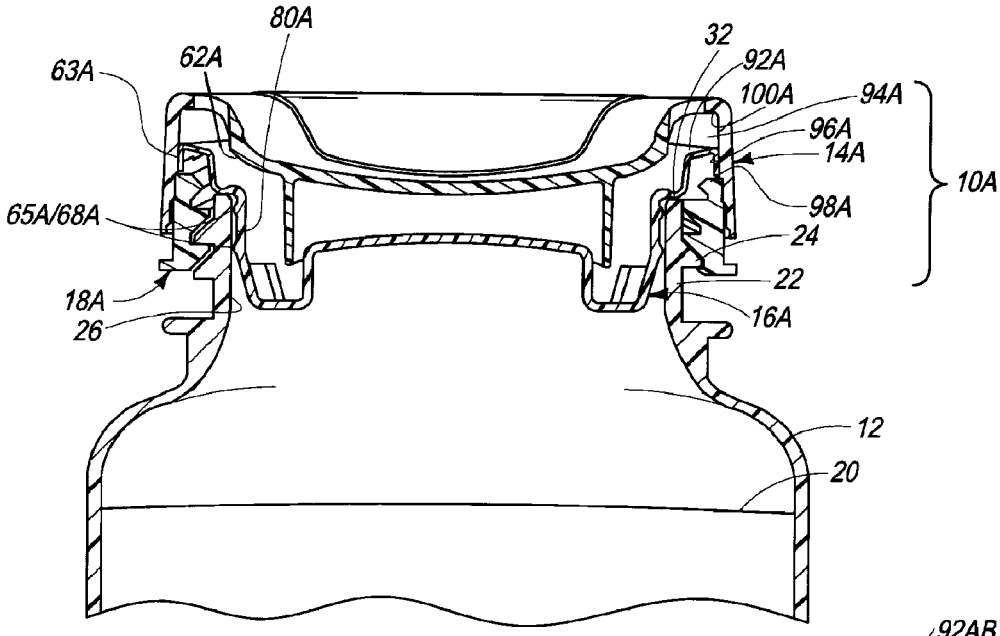
FIG. 10 is a cross sectional view of an alternate embodiment pour cap with a removeable gasket shown in the open position.
Figure 11:
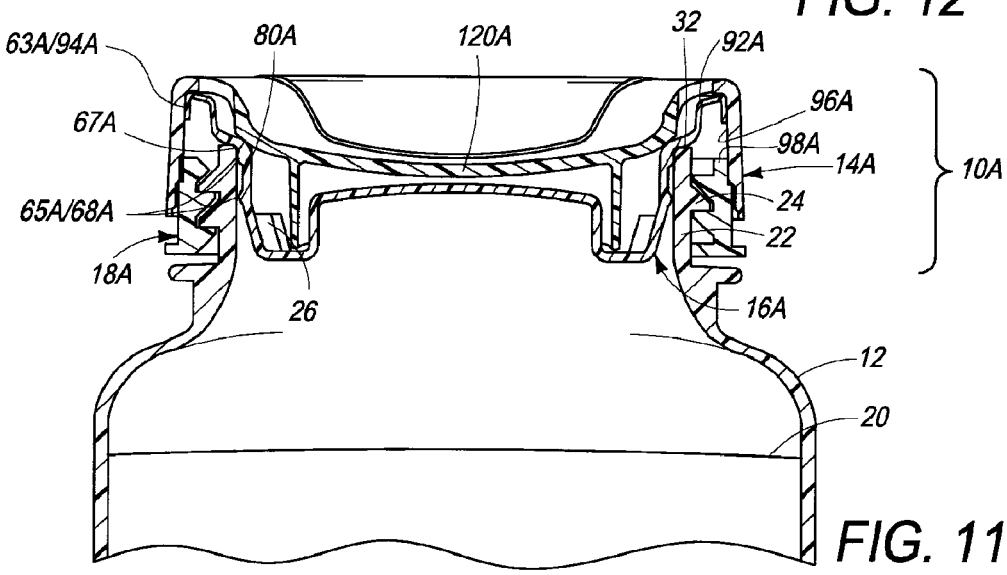
FIG. 11 is a cross sectional view of the alternate embodiment pour cap of FIG. 11 shown in the closed position.

As shown in FIGS. 10 and 11, the gasket 16A includes a moveable portion 92A on an upper portion 102A (FIG. 14), which as will be further explained, allows for a larger relative motion between the cap 10A and the container 12. In addition, the cap body 14A does not include the sealing rib 60 (FIG. 3), and the threaded ring 18A does not include the pinch rib 84 (FIG. 5). In the pour cap 10A, a tip of the gasket 16A forms a sealing lip 96A, which seals against a non drafted surface 94A on the cap body 14A to form a first low pressure seal 63A (FIG. 10). The sealing lip 96A is configured to slide between an edge 98A of the threaded ring 18A and an inner compression surface 100A on the cap body 14A. In particular, the sealing lip 96A can slide within this range of motion in the open position of the cap 10A such as during pouring or drinking of the fluid 20 from the container 12.

As shown in FIG. 10, when the pour cap 10A is initially screwed onto the container 12, the moveable portion 92A of the gasket 16A initially contacts surface 98A and is pushed upward until it contacts the upper surface 100A on the cap body 14A. During this motion, the sealing lip 96A of the gasket 16A contacts the smooth surface 94A on the cap body 14A to form the first low pressure seal 63A. As the cap 10A is fully tightened by clockwise rotation of the cap 10A to the closed position, the gasket 16A is compressed between the compression surface 62A on the cap body 14A and the top surface 32 and inside edge of the fluid container 12 to form the high pressure seal 67A (FIG. 11). As shown in FIG. 10, as the cap 10A is rotated counterclockwise to the open position, the moveable portion 92A of the gasket 16A will remain seated on the top surface 32 of the container neck 22, until the sealing lip 96A of the gasket 16A contacts the top edge 98A of the threaded ring 18A. If the cap 10A is rotated further in the counterclockwise direction, the gasket 16A will be pulled from its' seated position. With further cap rotation beyond this point, the cap 10A can be completely removed from the container 12.

Figure 14:
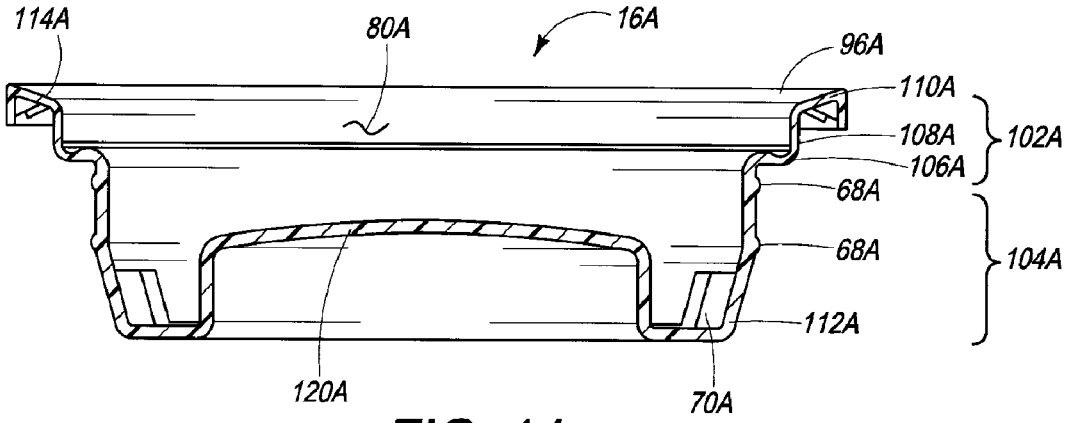
FIG. 14 is a cross sectional view of the gasket for the alternate embodiment pour cap of FIG. 10.
Figure 15:
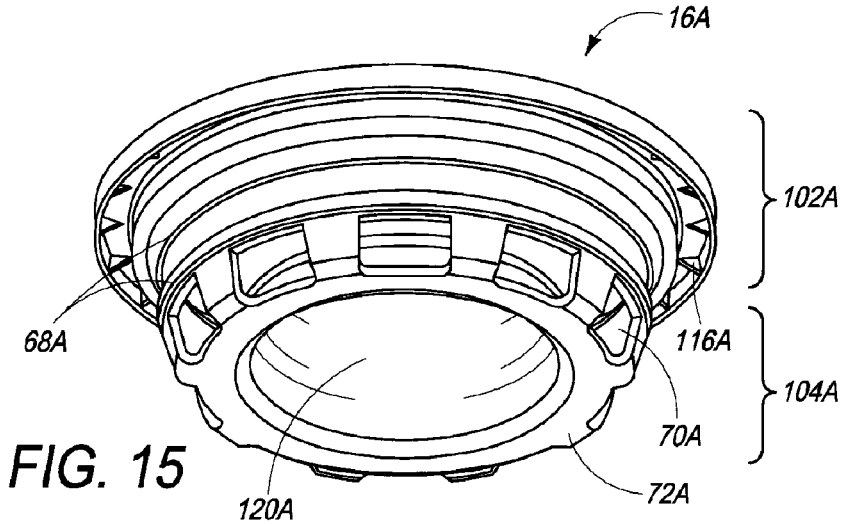
FIG. 15 is a perspective view of the gasket for the alternate embodiment pour cap of FIG. 10.

Referring to FIGS. 14 and 15, the gasket 16A has a specific shape that provides for optimal operation. The gasket 16A includes an upper portion 102A and a lower portion 104A. The lower portion 104A of the gasket 16A has a thicker wall thickness than the upper section 102A. This assures that there is a higher compressive force between the o-ring features 68A, and the inside diameter 26 (FIG. 11) of the container neck 22 (FIG. 11), than between the cap body 14A and the sealing lip 96A on the upper portion 102A of the gasket 16A. Stated differently, there is more friction between the gasket 16A and the inside diameter 26 (FIG. 11) of the container neck 22 (FIG. 11), than between the sealing lip 96A and the non drafted sealing surface 94A on the cap body 14A of the gasket 16A. This assures that the cap 10A can move upward and downward relative to the lower portion 104A of the gasket 16A, which remains stationary and seated in the inside diameter 26 (FIG. 11) of the container neck 22 (FIG. 11) to form the second low pressure seal 65A (FIG. 11). In this regard, the lower portion 104A of the gasket 16A must remain seated in the inside diameter 26 (FIG. 12) of the container neck 22 (FIG. 11) in the open position of the cap 10A to form the second low pressure seal 65A (FIG. 11) during pouring or drinking from the cap 10A.

Another feature of the thin wall of the upper portion 102A (FIG. 14) of the gasket 16A (FIG. 14) is that it is more flexible than the lower portion 104A (FIG. 14) of the gasket 16A (FIG.

14). This flexibility is critical because there is relative motion between the female threads 36A (FIG. 13) on the cap body 14A (FIG. 13) and the male threads 24 (FIG. 11) on the neck 22 (FIG. 11) of the container 12 (FIG. 11) due to clearances. These clearances are necessary for proper operation of the threads, and also occur due to variations in the manufacture of the cap 10A (FIG. 11) and the container 12 (FIG. 11). This relative motion can occur when the cap 10A (FIG. 11) is pushed from side to side or wiggled in an angular direction. In order to obtain the desired flexibility, the gasket 16A includes a radiused corner 106A (FIG. 14), a vertical wall 108A (FIG. 14), and the moveable portion 92A (FIG. 14) on an upper portion 102A thereof that are thinned. In particular, the gasket 16A includes thinned sidewalls 110A (FIG. 14) in the upper portion 102A above the radiused corner 106A (FIG. 14), and thick sidewalls 112A (FIG. 14) in the lower portion 104A below the radiused corner 106A (FIG. 14). According to good plastic injection mold practices, once the wall section is thinned at the radiused corner 106A (FIG. 14), all remaining downstream wall sections (i.e., lower portion 104A (FIG. 14) should be thinned. For economic reasons the gasket 16A can be made from a single material. However, the desired flexibility of the upper section 102A can be achieved using a more costly overmolding process. In this way, a more flexible material can form the upper portion 102A and join with a stiffer material used to form the lower portion 104A of the gasket 16A. This same method can be used to make the coefficient of friction of the upper portion 102A different than the lower portion 104A.

Figure 12:
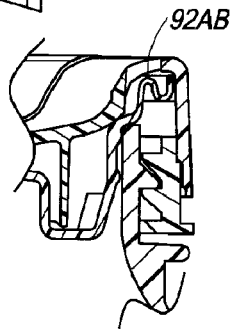
FIG. 12 is a cross sectional view of an alternate embodiment pour cap with a removeable bellows gasket shown in the closed position.

During use of the gasket 14A (FIG. 14), it is advantageous for the sealing lip 96A (FIG. 14) to maintain a perfectly round geometry when the cap 10A (FIG. 12) is moved side-to-side or wiggled. The gasket 14A (FIG. 14) is constructed such that the sealing lip 96A (FIG. 14) maintains its' round shape. As shown in FIG. 14, the sealing lip 96A includes a beveled surface 114A (FIG. 14) which stiffens the top edge of the sealing lip 96A (FIG. 14) so that it remains circular when the cap 10A (FIG. 12) is moved side-to-side or wiggled. If the sealing lip 96A (FIG. 14) were not made rigid by the beveled surface, it could flex in such a way that it would break contact with the smooth surface 94A (FIG. 12) on the side of the cap body 14A (FIG. 12). To stiffen the sealing lip 96A (FIG. 15) further, the gasket 16A (FIG. 15) includes ribs 116A (FIG. 15) which support the beveled surface 114A (FIG. 14) of the sealing lip 96A (FIG. 14). With this construction, the sealing lip 96A (FIG. 15) remains circular with any sideward motion of the cap 10A (FIG. 12). Further, the thinned vertical side wall 108A (FIG. 14) and the radiused corner 106A (FIG. 14) provide hinge points that allow the sealing lip 96A (FIG. 14) to maintain a hydraulic seal even if the cap 10A (FIG. 12) is pushed into a state of non-concentric alignment and/or wiggled upward or downward.

The beveled surface 114A (FIG. 14) is also angled to promote liquid flow into the container 12 (FIG. 12). The stiffening ribs 116A (FIG. 15) also keep the sealing lip 96A (FIG. 15) from turning inside out when the gasket 16A (FIG. 11) is pulled upward from the neck 22 (FIG. 11) of the container 12 (FIG. 11). Furthermore, the vertical length of the sealing lip 96A (FIG. 11) is sufficient to maintain contact with the smooth surface 94A (FIG. 11) when the cap 10A (FIG. 11) is wiggled angularly to an extreme position. If the maximum angular rotation is known, simple geometry can be used to calculate the length of the sealing lip 96A (FIG. 11) that will insure that contact is maintained.

As shown in FIG. 12, the moveable portion 92A (FIG. 11) can be shaped as a bellows moveable portion 92AB which allows an even greater range of cap and bottle misalignment.

Figure 13:
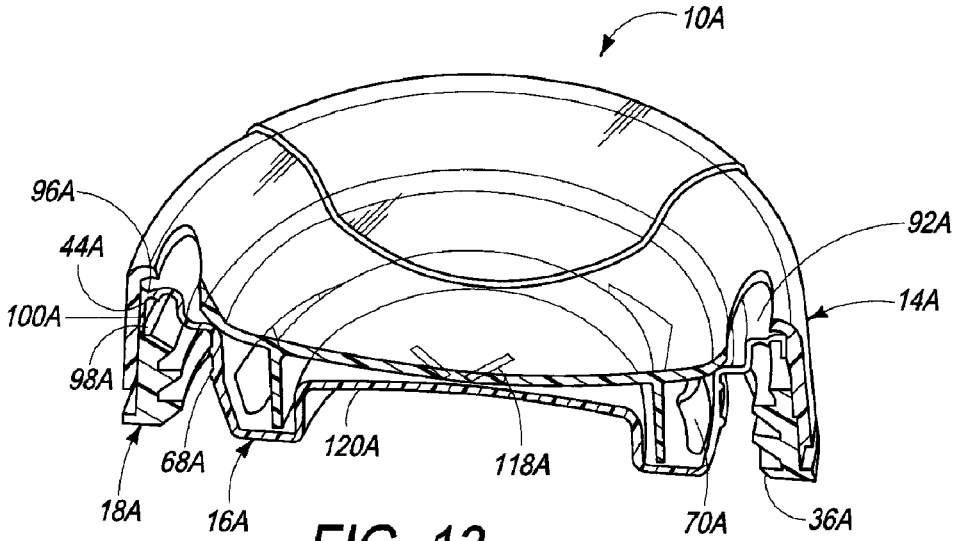
FIG. 13 is a perspective view partially cut away of the alternate embodiment pour cap of FIG. 10.

As shown in FIG. 13, a top surface 120A of the gasket 10A can also include an alignment feature 118A such as a raised cross. With the cap body 14A being made of a transparent material, the alignment feature 118A (FIG. 13) can be used to indicate whether the cap 10A (FIG. 13) is fully tightened or not. In particular, when the cap 10A (FIG. 13) is tightened, the alignment feature 118A (FIG. 13) will contact the cap body 14A (FIG. 13). If the cap 10A (FIG. 13) is molded from a transparent material, the contact between the gasket 16A (FIG. 13) and the cap body 14A (FIG. 13) will make the shape of the alignment feature 118A (FIG. 13) visible through the cap body 14A (FIG. 13). When the cap 10A (FIG. 13) is loosened, and contact between the cap body 14A (FIG. 13) and gasket 16A (FIG. 13) is broken, the alignment feature 118A (FIG. 13) will not be seen with clarity.

Figure 16:
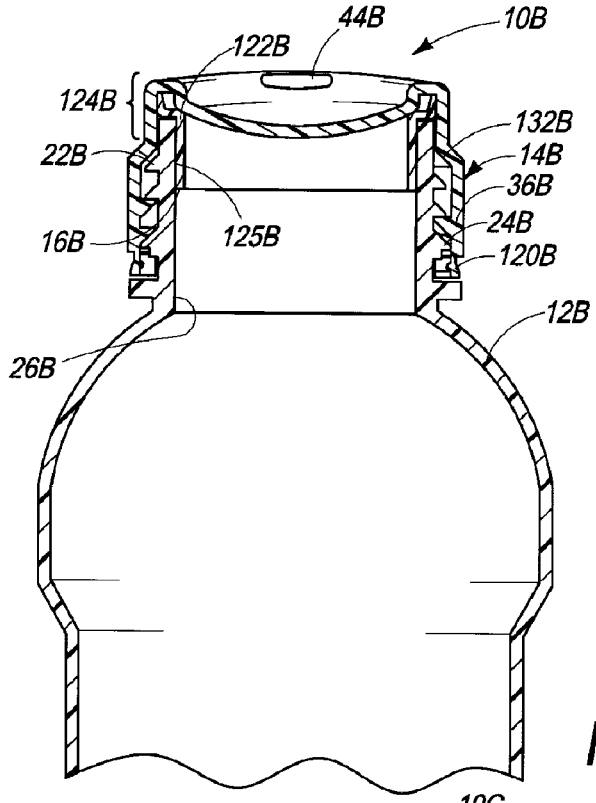
FIG. 16 is a cross sectional view of an alternate embodiment single use pour cap having a tamper ring attached to a disposable container.

Referring to FIG. 16, an alternate embodiment pour cap 10B is constructed for use with a disposable, single use, container 12B, such as a beverage container adapted to contain water, vitamin enriched water, juice or soda. In this application, assuring low cost and ease of high volume assembly are critical. The cap 10B includes a cap body 14B having a pour opening 44B, a gasket 16B and a tamper proof ring 120B for safety purposes. Alternately, a heat shrink film (not shown) can be placed around the cap 10B in place of the tamper proof ring 120B. The shrink film has the advantage that it provides a sanitary barrier as well as a safety seal.

As shown in FIG. 16, the cap body 14B includes female threads 36B that mate with male threads 24B on an inside diameter 26B of the neck of the container 12B. The cap body 14B has a one piece construction so there is no discrete thread ring as in the previous embodiments. The cap body 14B and the tamper proof ring 120B can also be formed with a one piece construction. The gasket 16B fits within the container neck 26B and acts as a seal between the container 12B and the cap body 14B in three different places. A high pressure seal 122B is formed by pinching of the gasket 16B when the cap 10B is in a closed position. This high pressure seal 122B insures the contents don't leak when the cap 10B is fully tightened. A first low pressure seal 124B is formed between the gasket 16B and the cap body 14B and a second low pressure seal 125B is formed between the container neck 26B and the gasket 16B. The low pressure seals 124B, 125B prevent fluid from pouring down the neck 22B of the container 12B, when the cap 10B is in the open position and the fluid contents are poured though holes 44B in the cap 10B. In addition, angled surfaces 132B are required to guide the interfering surfaces together during assembly.

Figure 17:
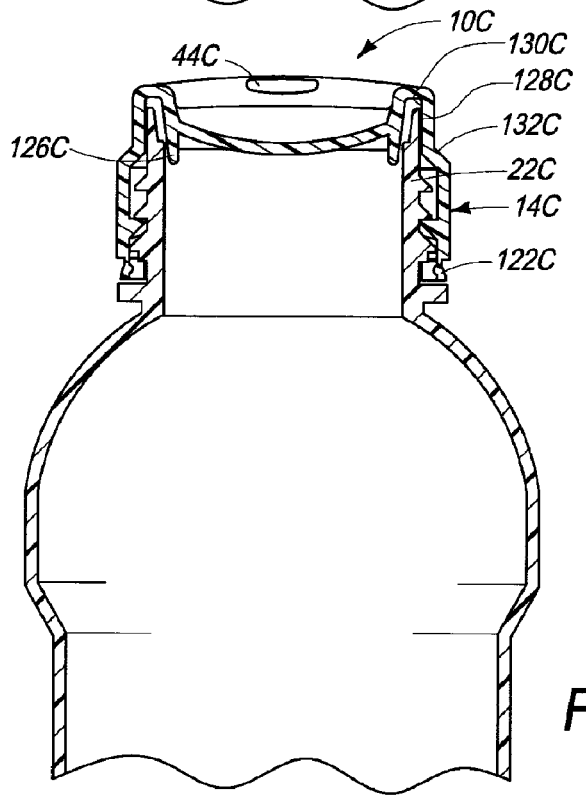
FIG. 17 is a cross sectional view of an alternate embodiment single use pour cap without a gasket attached to a disposable container.

Referring to FIG. 17, an alternate embodiment pour cap 10C is substantially similar to pour cap 10B (FIG. 16) and includes a cap body 14C having a pour opening 44C, and a tamper proof ring 122C, but no gasket. This construction is the cheapest and easiest to assemble. The cap 10C (FIG. 17), and the cap 10B (FIG. 16) as well, require the neck 22C of the container 12C and the sealing surfaces 126C, 128C and 130C on the cap body 14C to be free of draft and parting lines. In the pour cap 10C, the neck 22C of the container 12C contacts the sealing surface 126C on the cap body 14C which seals against the inside diameter of the neck 22C. As also shown in FIG. 17, there needs to be a slight interference fit between the second sealing surface 130C and the outside diameter of the neck 128C to insure constant contact between mating surfaces. This requirement can be achieved using a thin wall, made from easily malleable polyethylene material. With undersizing of the cap 10C, it can stretch over the neck 22C and over time, relax any stress that occurred due to the interference fit. Furthermore, polyethylene offers little friction when sliding against the container 12C, so that the interference fit will not cause excessive drag when screwing the cap 10C open and closed. Lastly, it should be noted that angled surfaces 132C are necessary to guide the interfering surfaces together during assembly.

Figure 18:
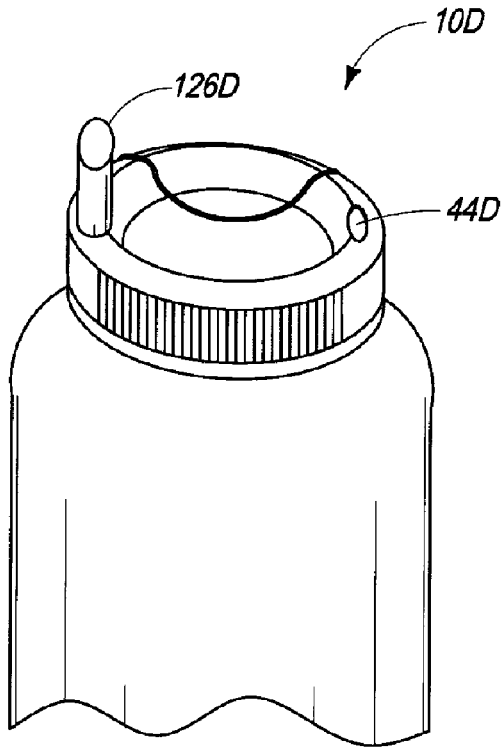
FIG. 18 is a perspective view of an alternate embodiment pour cap having a non drip nozzle.

Referring to FIG. 18, an alternate embodiment pour cap 10D is substantially similar to the pour cap 10 (FIG. 1) or the pour cap 10A (FIG. 11). In addition, the pour cap 10D includes a spout 126D formed on one or more pour openings 44D on the pour cap 10D. The spout 126D allows a fluid, such as toxic liquid, to be more easily poured from the pour cap 10D.

Figure 19:
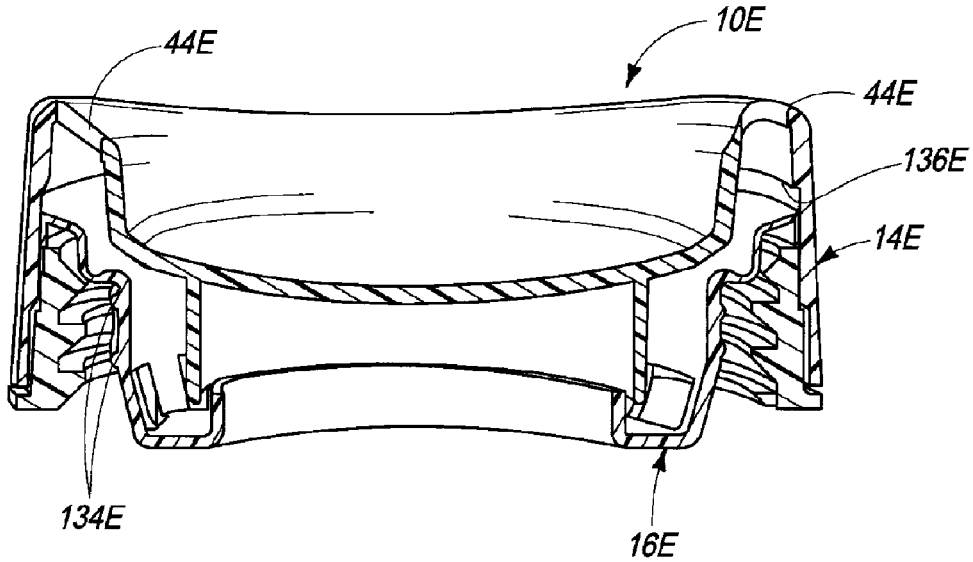
FIG. 19 is a cross sectional view of an alternate embodiment pour cap having an alternate embodiment cap body.

Referring to FIG. 19, an alternate embodiment pour cap 10E is substantially similar to the pour cap 10 (FIG. 1) or the pour cap 10A (FIG. 11). The alternate embodiment pour cap 10E has several improvements. Firstly, the pour openings 44E are positioned on the uppermost portion, or on the crests of the cap body 14E, so only a glance is required to orient the cap 10E to a drinking position. The cap 10E is perfectly round which requires a search for the location of the pour openings 44E before orienting to one's lips. Secondly, there is a greater distance between the pour openings 44E and the gasket 16E so fluid flows back into the container 12 (FIG. 1) with a greater momentum to counter act meniscus forces that can cause the fluid to collect in the narrow gaps between the gasket 16E and the cap body 14E. Thirdly, there is a greater volume of empty space (gas) above the gasket 16E to absorb a pressure pulse when a pressurized container 12 (FIG. 1) is quickly opened. Pressure can occur in a container 12 (FIG. 1) due to carbonation, or when the fluid is heated after the cap 10E has been placed in the closed position. Fourthly, the cap body 14E includes a ridge 136E that straightens the top edge of the gasket 16E if the cap 10E is not on a container, and the gasket 16E is pushed upward within the cap body 14E. A chamfer 134E on the o-ring features of the gasket 16E also help to guide the gasket 16E smoothly into the inside diameter of the container neck.

Thus the disclosure describes an improved pour cap for fluid containers and an improved method for pouring fluids from containers. While the description has been with reference to certain preferred embodiments, as will be apparent to those skilled in the art, certain changes and modifications can be made without departing from the scope of the following claims.

What is claimed is:

1. A cap for a container adapted to contain a fluid comprising:

a cap body configured for attachment to a neck of the container having at least one pour opening through which the fluid can be poured from the container, the cap body moveable by rotation on the neck of the container to an open position or to a closed position and;

a deformable gasket attached to the cap body having a fluid flow opening, a first portion configured to form a first seal on the cap body, and a second portion configured to form a second seal on an inside diameter or a top surface of the neck of the container, the gasket configured for deformation and compression by the cap body in the closed position to form a third seal on a top surface of the neck of the container, the gasket configured to form a fluid flow passage through the gasket in the open position allowing fluid flow from the container through the fluid flow opening in the gasket to the pour opening in the cap body while maintaining the first seal and the second seal, the fluid flow passage sealed in the closed position and having a maximum size in the open position controlled by movement of the gasket to an undeformed state; and a support rib on the cap body configured to fit into the neck of the container for maintaining a shape of the gasket during placement on the bottle and during storage of the cap when not on the bottle.

2. The cap of claim 1 further comprising a threaded ring attached to the cap body having female threads that mate with male threads on the neck of the container.

3. A cap for a container adapted to contain a fluid comprising:

a cap body configured for attachment to a neck of the container having a threaded ring and at least one pour opening through which the fluid can be poured from the container, the cap body moveable by rotation on the neck of the container to an open position or to a closed position and a deformable gasket attached to the cap body having a fluid flow opening, a first portion configured to form a first seal on the cap body, and a second portion configured to form a second seal on an inside diameter or a top surface of the neck of the container, the gasket configured for deformation and compression by the cap body in the closed position to form a third seal on a top surface of the neck of the container, the gasket configured to form a fluid flow passage through the gasket in the open position allowing fluid flow from the container through the fluid flow opening in the gasket to the pour opening in the cap body while maintaining the first seal and the second seal, the fluid flow passage sealed in the closed position and having a maximum size in the open position controlled by movement of the basket to an undeformed state;

wherein the first portion of the gasket seats in a groove in the cap body and a groove in the threaded ring to form the first seal.

4. The cap of claim 3 wherein the first portion of the gasket moves against a sealing surface on the cap body to form the first seal.

5. A cap for a container adapted to contain a fluid comprising:

a cap body configured for attachment to a neck of the container having at least one pour opening through which the fluid can be poured from the container, the cap body moveable by rotation on the neck of the container to an open position or to a closed position and;

a deformable gasket attached to the cap body having a fluid flow opening, a first portion configured to form a first seal on the cap body, and a second portion configured to form a second seal on an inside diameter or a top surface of the neck of the container, the gasket configured for deformation and compression by the cap body in the closed position to form a third seal on a top surface of the neck of the container, the gasket configured to form a fluid flow passage through the gasket in the open position allowing fluid flow from the container through the fluid flow opening in the gasket to the pour opening in the cap body while maintaining the first seal and the second seal, the fluid flow passage sealed in the closed position and having a maximum size in the open position controlled by movement of the gasket to an undeformed state;

wherein the second portion of the gasket includes an o-ring feature configured to seat in the inside diameter or an edge of the neck of the container to form the second seal.

6. The cap of claim 5 wherein the cap body includes female threads that mate with male threads on a neck of the container.

7. A cap for a container adapted to contain a fluid comprising:

a cap body configured for attachment to a neck of the container having at least one pour opening through which the fluid can be poured from the container, the cap body moveable by rotation on the neck of the container to an open position or to a closed position and;

a deformable gasket attached to the cap body having a fluid flow opening, a first portion configured to form a first seal on the cap body, and a second portion configured to form a second seal on an inside diameter or a top surface of the neck of the container, the gasket configured for deformation and compression by the cap body in the closed position to form a third seal on a top surface of the neck of the container, the gasket configured to form a fluid flow passage through the gasket in the open position allowing fluid flow from the container through the fluid flow opening in the gasket to the pour opening in the cap body while maintaining the first seal and the second seal, the fluid flow passage sealed in the closed position and having a maximum size in the open position controlled by movement of the gasket to an undeformed state;

wherein the gasket includes at least one thinned segment configured to maintain flexibility and provide a localized place of predictable deformation in the open position of the pour cap for maintaining the first seal and the second seal, and the maximum size of the flow passage.

8. The cap of claim 7 further comprising a spout attached to the pour opening.

9. A cap for a container adapted to contain a fluid having a threaded neck comprising:

a cap body having at least one pour opening through which the fluid can be poured from the container;

a threaded ring on the cap body movable with rotation on the threaded neck to place the cap in an open position or in a closed position; and a deformable gasket attached to the cap body having a first portion configured to form a first low pressure seal on the cap body, a sealing surface configured for compression by the cap body to seal the container in the closed position with a high pressure seal and with the gasket configured for return to an essentially undeformed state to form a fluid flow passage through the gasket in the open position, an o-ring feature configured to seat in an inside diameter of the threaded neck to form a second low pressure seal, and a fluid flow opening configured to allow fluid flow through the fluid flow passage and the pour opening in the open position, the fluid flow passage having a size controlled by movement of the gasket to the undeformed state.

10. The cap of claim 9 further comprising a support rib on the cap body configured to fit into the neck of the container for maintaining a shape of the gasket during placement on the bottle and during storage of the cap when not on the bottle.

11. The cap of claim 9 wherein the cap body includes a second sealing surface configured to compress the sealing surface on the gasket against a surface or an edge of the threaded neck to form the high pressure seal.

12. The cap of claim 9 wherein the first portion of the gasket comprises a moveable portion having a sealing lip configured to seal against an inside surface of the cap body.

13. The cap of claim 12 wherein the moveable portion has a bellows shape.

14. The cap of claim 9 wherein the gasket includes at least one thinned segment configured to maintain flexibility and provide a localized place of predictable deformation in the open position of the pour cap for maintaining the first low pressure seal and the second low pressure seal, and the maximum size of the flow passage.

15. The cap of claim 9 wherein the gasket further includes an alignment feature viewable through the cap body for ascertaining the closed position or the open position.

16. The cap of claim 9 further comprising at least one detent on the cap body configured to communicate the open position by noise or resistance.

17. The cap of claim 9 wherein the gasket comprises a plurality of thinned segments configured to control a deformation of the gasket and the maximum size of the flow passage in the open position.

18. A cap for a container adapted to contain a fluid having a threaded neck comprising:

a cap body having a plurality of pour openings through which the fluid can be poured from the container, and an inner surface;

a threaded ring on the cap body movable with rotation on the threaded neck to place the cap in an open position or in a closed position; and a deformable gasket attached to the cap body comprising:

a moveable portion configured to form a first low pressure seal on the inner surface of the cap body;

a sealing surface configured for compression by the cap body to seal the container in the closed position with a high pressure seal and for return to an essentially undeformed state to form a fluid flow passage through the gasket in the open position, an o-ring feature configured to seat in an inside diameter or an edge of the threaded neck to form a second low pressure seal, and a plurality of fluid flow openings in the gasket configured to allow fluid flow through the gasket to the fluid flow passage and the pour openings in the open position, and a plurality of thinned segments configured to control a deformation of the gasket so that the fluid flow passage has a maximum size in the open position.

19. The cap of claim 18 wherein the moveable portion has a bellows shape.

20. A method for sealing and pouring a fluid from a container having a threaded neck comprising:

providing a pour cap having a cap body with one or more pour openings, a deformable gasket on the cap body having a fluid flow opening, a first portion configured to form a first seal on the cap body, and a second portion configured to form a second seal on an inside diameter or a top surface of the neck of the container, and a threaded ring on the cap body having threads for engaging the threaded neck on the container;

tightening the cap body on the threaded neck of the container to a closed position wherein deformation of the gasket seals the container with a high pressure seal;

rotating the cap body on the threaded neck of the container to an open position wherein the gasket returns to an essentially undeformed state to form a fluid flow passage through the gasket, while maintaining the first seal and the second seal for preventing unwanted fluid flow through the cap body and the threaded ring; and controlling a deformation of the gasket in the open position using a plurality of thinned segments on the gasket so that the fluid flow passage has a maximum size in the open position.

21. The method of claim 20 further comprising in the open position, pouring the fluid through the gasket, through the flow passage, and through the pour openings in the cap body.

22. The method of claim 20 further comprising providing the gasket with a sealing lip adapted to seal an inside surface of the cap body to form the first low pressure seal, and an o-ring feature configured to form the second low pressure seal in the neck of the container.

23. The method of claim 20 further comprising providing the cap body with a support rib configured to fit into the neck of the container for maintaining a shape of the gasket during placement on the bottle and during storage of the cap when not on the bottle.

* * * * *

UNITED STATES PATENT AND TRADEMARK OFFICE

CERTIFICATE OF CORRECTION

PATENT NO. : 8,210,375 B2
APPLICATION NO. : 12/062652
DATED : July 3, 2012
INVENTOR(S) : Robert A. Heibeger It is certified that error appears in the above-identified patent and that said Letters Patent is hereby corrected as shown below:

In the Claims:

Column 12, line 3, claim 1
Delete “bottle” and add --container--.

Column 12, line 4, claim 1
Delete “bottle” and add --container--.

Signed and Sealed this
Twentieth Day of August, 2013

Teresa Stanek Rea
*Acting Director of the United States Patent and Trademark Office*